US007284297B2

(12) United States Patent
Shanor et al.

(10) Patent No.: US 7,284,297 B2
(45) Date of Patent: Oct. 23, 2007

(54) HOLDER FOR ALTERNATELY RECEIVING WAND OR CLEANING TOOL

(75) Inventors: Michael J. Shanor, Nicholasville, KY (US); Michael S. Yacobi, Lexington, KY (US); Amy N. Mudd, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 544 days.

(21) Appl. No.: 10/825,383

(22) Filed: Apr. 15, 2004

(65) Prior Publication Data

US 2004/0205925 A1 Oct. 21, 2004

Related U.S. Application Data

(60) Provisional application No. 60/463,494, filed on Apr. 17, 2003.

(51) Int. Cl.
*A47L 9/00* (2006.01)

(52) U.S. Cl. ..... 15/323; 15/246.2

(58) Field of Classification Search ..... 15/323, 15/246.2; *A47L 9/00*
See application file for complete search history.

(56) References Cited

U.S. PATENT DOCUMENTS 2,450,172 A * 9/1948 Stoner ..... 15/323
4,597,551 A 7/1986 Ciechanowski et al.
4,653,638 A * 3/1987 Lackner et al. ..... 15/323
4,761,850 A 8/1988 Romeo et al.
D344,616 S 2/1994 Berfield et al.
5,313,686 A * 5/1994 Berfield ..... 15/323
5,313,687 A 5/1994 Schneider
5,528,794 A * 6/1996 Tomasiak ..... 15/323
D374,523 S 10/1996 Tomasiak
6,058,558 A * 5/2000 Kim ..... 15/323
D426,358 S 6/2000 Saunders et al.
6,098,241 A 8/2000 Wood
D434,886 S 12/2000 Wareham et al.
D444,603 S 7/2001 Murphy et al.
6,260,233 B1 7/2001 Wareham et al.
6,345,407 B1 2/2002 Jupp
D463,079 S 9/2002 Leyden
6,510,582 B1 1/2003 Yoo
6,832,408 B2 * 12/2004 Roney et al. ..... 15/323

FOREIGN PATENT DOCUMENTS

GB 2346802 * 8/2000

* cited by examiner

*Primary Examiner*—Theresa T. Snider
(74) *Attorney, Agent, or Firm*—King & Schickli PLLC

(57) ABSTRACT

A tool holder is provided for a floor cleaning apparatus. The tool holder includes a body having both a wand receiver and a cleaning tool receiver.

18 Claims, 6 Drawing Sheets

HOLDER FOR ALTERNATELY RECEIVING WAND OR CLEANING TOOL

This application claims the benefit of U.S. Provisional Patent Application Ser. No. 60/463,494 filed on Apr. 17, 2003.

TECHNICAL FIELD

The present invention relates generally to the floor care equipment field and, more particularly, to a holder, that is mounted on a floor care cleaning apparatus and adapted to alternately hold a wand or crevice tool utilized with the cleaning apparatus to perform manual cleaning tasks.

BACKGROUND OF THE INVENTION

Floor care cleaning equipment such as canister vacuum cleaners and upright vacuum cleaners have long been known in the art. Such vacuum cleaners incorporate either a bag-like filter or a cyclonic separation chamber and filter combination that trap dirt and debris while substantially clean air is exhausted by an electrically operated fan that is driven by an onboard motor. It is this fan and motor arrangement that generates the drop in air pressure necessary to provide the desired cleaning action.

Many upright vacuum cleaners today are equipped with a manually manipulatable wand and associated cleaning tool such as a crevice cleaning tool to allow for above-floor cleaning or cleaning in confined spaces otherwise inaccessible to the nozzle assembly of the upright vacuum cleaner. The present invention relates to a holder particularly adapted to hold both the wand and crevice tool at an easily accessible location so that they may be conveniently used by the operator.

SUMMARY OF THE INVENTION

In accordance with the purposes of the present invention as described herein a tool holder is provided for a floor cleaning apparatus that includes both a wand and a crevice tool. The tool holder comprises a body, a first means on the body for holding the wand and a second means on the body for holding the crevice tool.

Alternatively, the tool holder may be defined as comprising a body including a wand receiver and a cleaning tool receiver for holding, for example, a crevice tool.

The tool holder may further include a lug for mounting the body to the floor cleaning apparatus such as the housing of an upright vacuum cleaner. Additionally, the tool holder may include a clip. A conduit joiner has a mounting section that is held by the clip. The conduit joiner allows a flexible hose leading from the nozzle assembly to be connected to a conduit leading to the dust collection vessel carried by the vacuum cleaner.

The first or wand receiver of the tool holder may be further defined as including a socket and a stabilizer. That socket includes an end wall. The second or cleaning tool receiver is provided in the end wall and may comprise, for example, an elongated slot.

In accordance with yet another aspect of the present invention a method is provided for holding a wand and crevice tool in a holder on a floor cleaning apparatus. The method includes the steps of holding the wand in the holder and the crevice tool in the wand when the wand and crevice tool are not in use and holding the crevice tool in the holder when the wand is in use without the crevice tool.

In accordance with yet another aspect of the present invention a vacuum cleaner is provided including the tool holder as described in this document.

BRIEF DESCRIPTION OF THE DRAWINGS

The accompanying drawings incorporated in and forming a part of the specification, illustrate several aspects of the present invention, and together with the description serve to explain certain principles of the invention. In the drawings.

Reference will now be made in detail to the present preferred embodiment of the invention, an example of which is illustrated in the accompanying drawing.

DETAILED DESCRIPTION OF THE INVENTION

Figure 1:
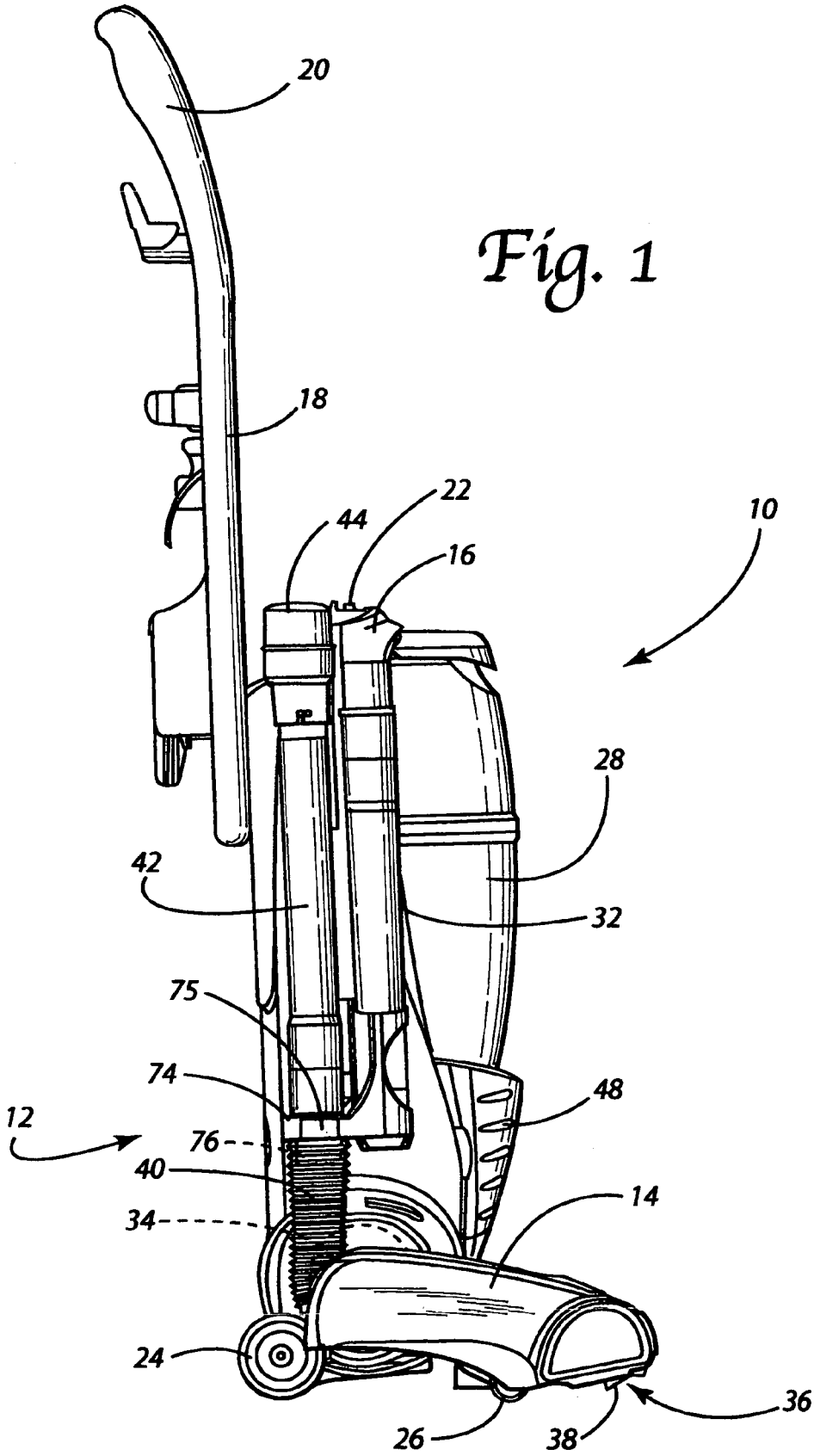
FIG. 1 is a side elevational view of an upright vacuum cleaner incorporating the tool holder of the present invention.

Reference is now made to FIG. 1 showing an upright vacuum cleaner 10 equipped with the tool holder 12 of the present invention. The upright vacuum cleaner 10 includes a housing comprising a nozzle assembly 14 and a canister assembly 16. The canister assembly 16 further includes a control handle 18 and a hand grip 20. A control switch 22 is provided for turning the vacuum cleaner on and off. Of course, electrical power is supplied to the vacuum cleaner 10 from a standard electrical wall outlet through a cord (not shown).

A pair of rear wheels 24 (only one shown in the drawing figure) are provided on the lower portion of the canister assembly 16 and a pair of front wheels 26 (again only one shown in the drawing figure) are provided on the nozzle assembly 14. Together, these wheels 24, 26 support the vacuum cleaner 10 for movement across the floor. To allow for convenient storage of the vacuum cleaner 10, a foot latch (not shown) functions to lock the canister assembly 16 in an upright position as shown in FIG. 1. When the foot latch is released, the canister assembly 16 may be pivoted relative to the nozzle assembly 14 as the vacuum cleaner is manipulated to-and-fro to clean the floor.

The canister assembly 16 includes a cavity 32 adapted to receive and hold a dirt collection vessel 28. As illustrated, the dirt collection vessel 28 is a removable dirt cup. The dirt collection vessel 28 may incorporate a cylindrically shaped chamber and a tangentially oriented inlet if desired in order to take advantage of cyclonic air flow to enhance cleaning performance. Alternatively, it should be appreciated that the dirt collection vessel 28 could hold a filter bag of a type known in the art. In yet another alternative embodiment, a filter bag could be substituted for the dirt cup and held in the cavity 32 of the canister assembly 16 behind an access door.

The canister assembly 16 also carries a suction generator 34 consisting of a cooperating fan and drive motor that function to generate a vacuum airstream for drawing dirt and debris from the surface to be cleaned. While the suction generator 34 is illustrated as being carried on the canister assembly 16, it should be appreciated that it could likewise be carried on the nozzle assembly 14 if desired.

The nozzle assembly 14 includes a nozzle and agitator cavity 36 that houses at least one rotating agitator 38 including bristle tufts, brushes, wipers, beaters or the like. The agitator 38 is rotatably driven by the motor of the suction generator 34 by means of a power transmission of a type known in the art incorporating cooperating belts and pulleys, meshing gears or both.

The scrubbing action of the rotary agitator 38 and the negative air pressure created by the suction generator 34 cooperate together to brush and beat dirt and debris from the nap of the carpet being cleaned and then draw the dirt and dust laden air from the agitator cavity 36 to the dirt collection vessel 28. Specifically, the dirt and dust laden air passes serially from the agitator cavity 36 through the flexible hose 40, the wand conduit 42, a second flexible hose 44 to an inlet port (not shown). The inlet port is connected to an internal delivery conduit (not shown) that delivers air through the housing of the canister assembly 16 into the dirt collection vessel 28. The dirt collection vessel 28 serves to trap the suspended dirt, dust and other particles inside while allowing the now clean air to pass freely through to the suction generator 34 where that air passes over the motor of the generator to provide cooling before being exhausted through a final filtration cartridge (not shown) and ultimately to the environment through the exhaust port 48.

Figure 2:
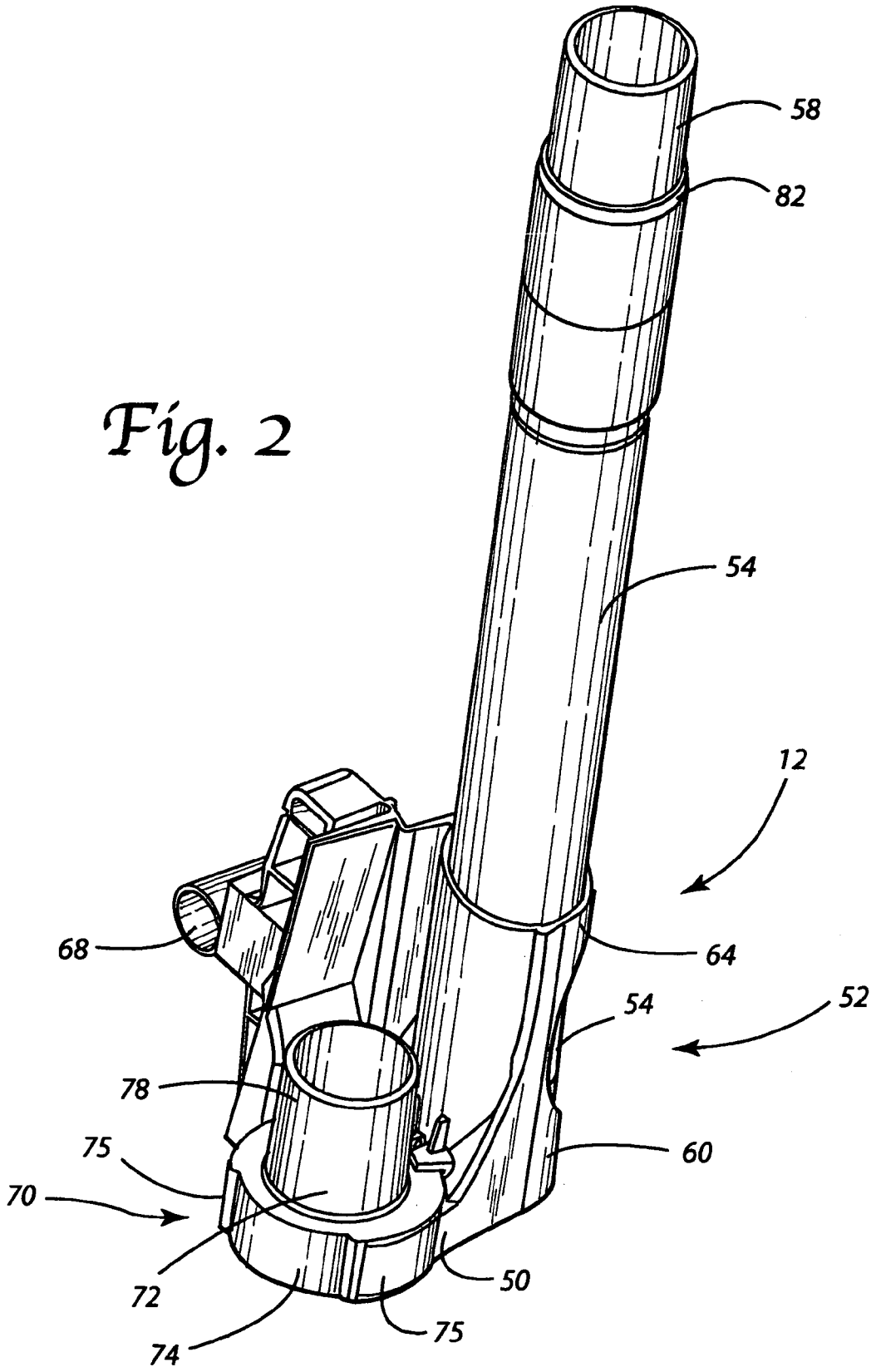
FIG. 2 is a detailed perspective view showing the holder of the present invention holding the extension wand with the crevice tool nested in the extension wand.
Figure 3A:
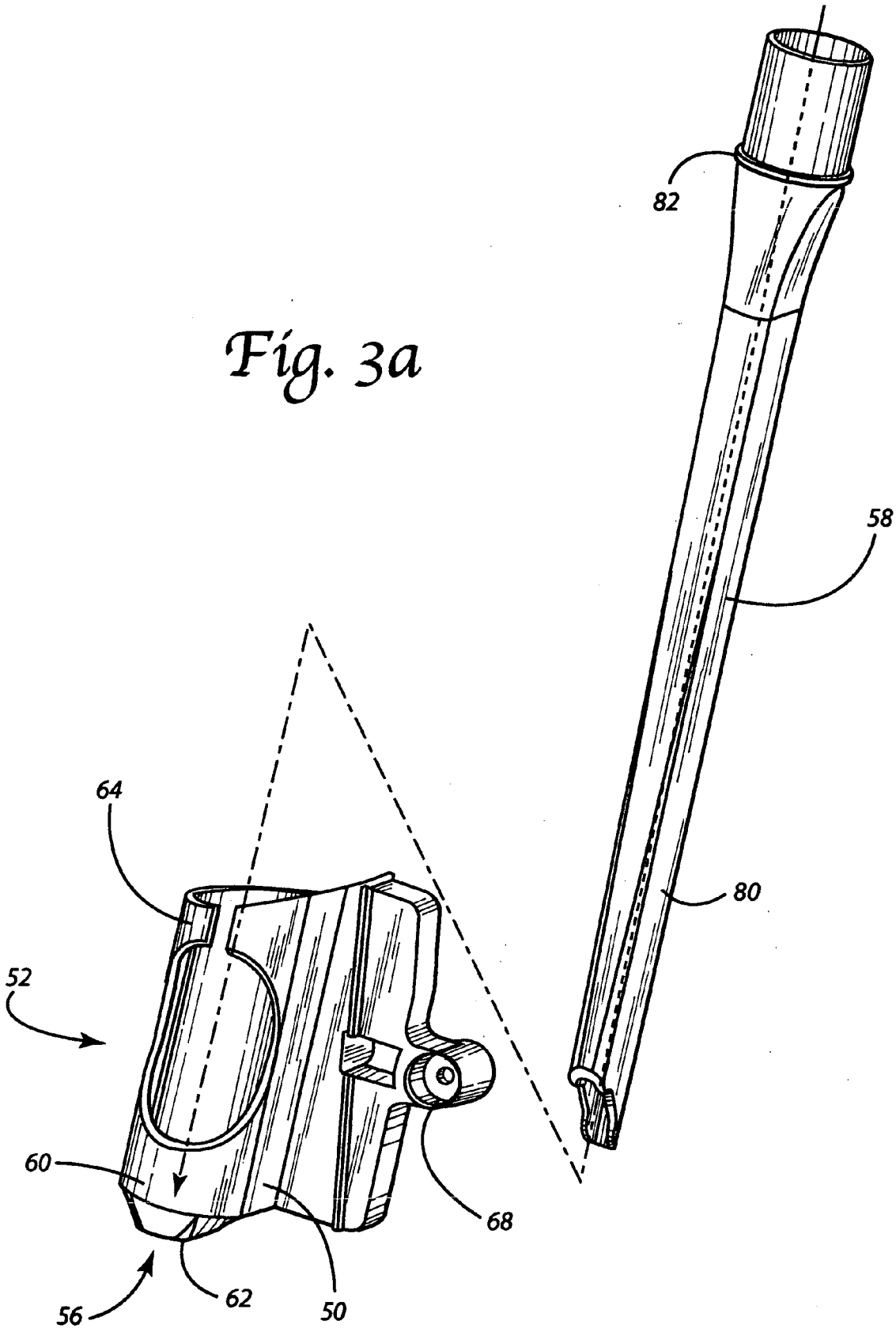
FIGS. 3*a* and 3*b* are detailed perspective views illustrating the positioning of the crevice tool in the holder of the present invention.
Figure 3B:
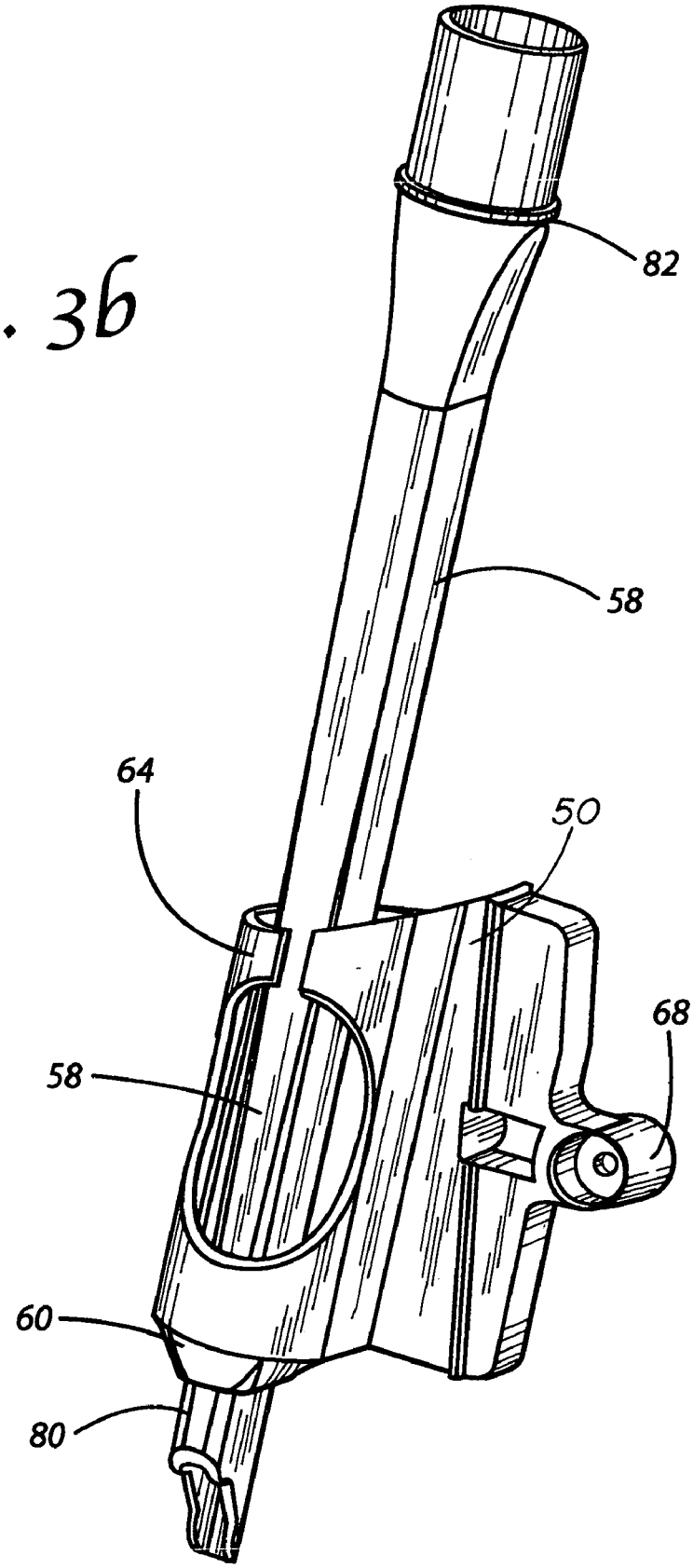
Figure 4:
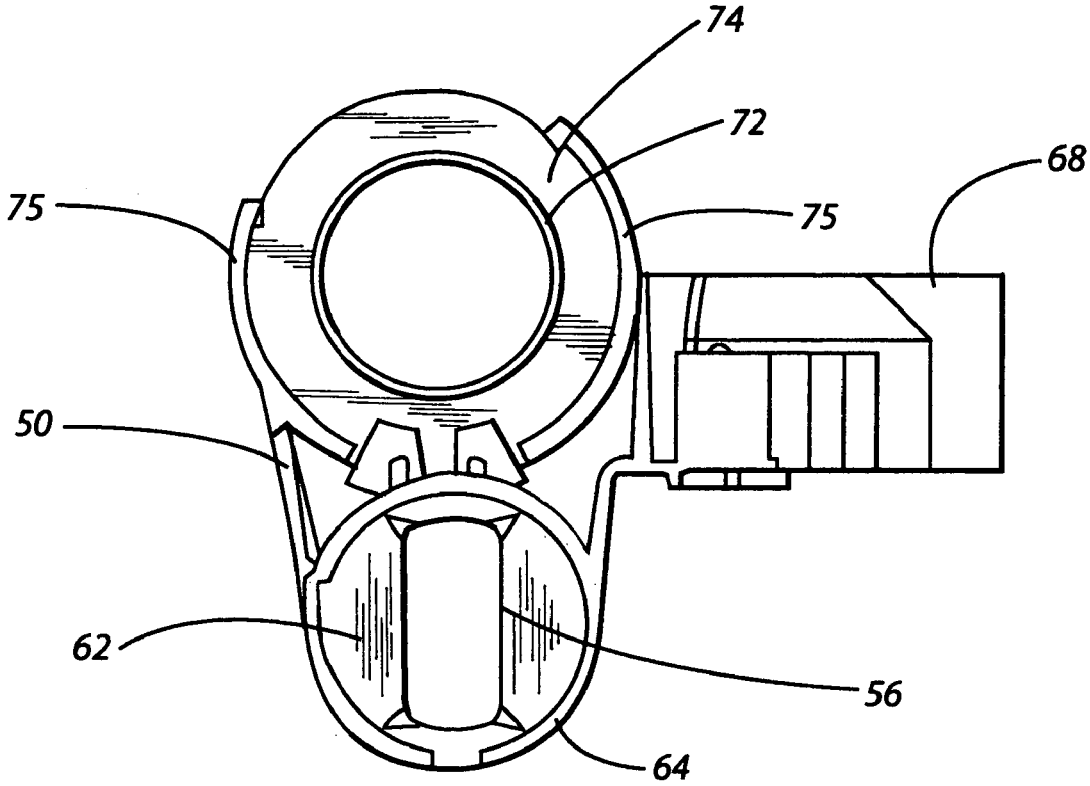
FIG. 4 is a top plan view of the holder.

As illustrated in FIG. 1, the upright vacuum cleaner 10 is equipped with the tool holder 12. As illustrated in FIGS. 2, 3*a* and 3*b*, the tool holder 12 comprises a body 50 including a first receiver 52 for holding the wand extension 54 (see FIG. 2) and a second receiver 56 for holding the crevice tool 58 when the wand extension is not being held in the first receiver (see FIGS. 3*a* and 3*b*). More specifically, the first or wand receiver 52 includes a socket 60 having an end or bottom wall 62 and a stabilizer 64 in the form of an open loop. The second or cleaning tool receiver 56 is provided in the end wall 62 of the socket 60. As illustrated, the second receiver 56 takes the form of the elongated slot in that end wall 62.

The tool holder 12 also includes a mounting lug 68 on the body 50 for securing the tool holder to the vacuum cleaner 10. More particularly, the lug 68 may be captured between cooperating housing sections of the canister assembly 16 in order to secure the tool holder 12 in position. In order to further rigidify that connection, a fastener such as a screw may be received in the lug to complete the connection. That same screw may also function to hold the two housing sections of the canister assembly 16 together.

Figure 5:
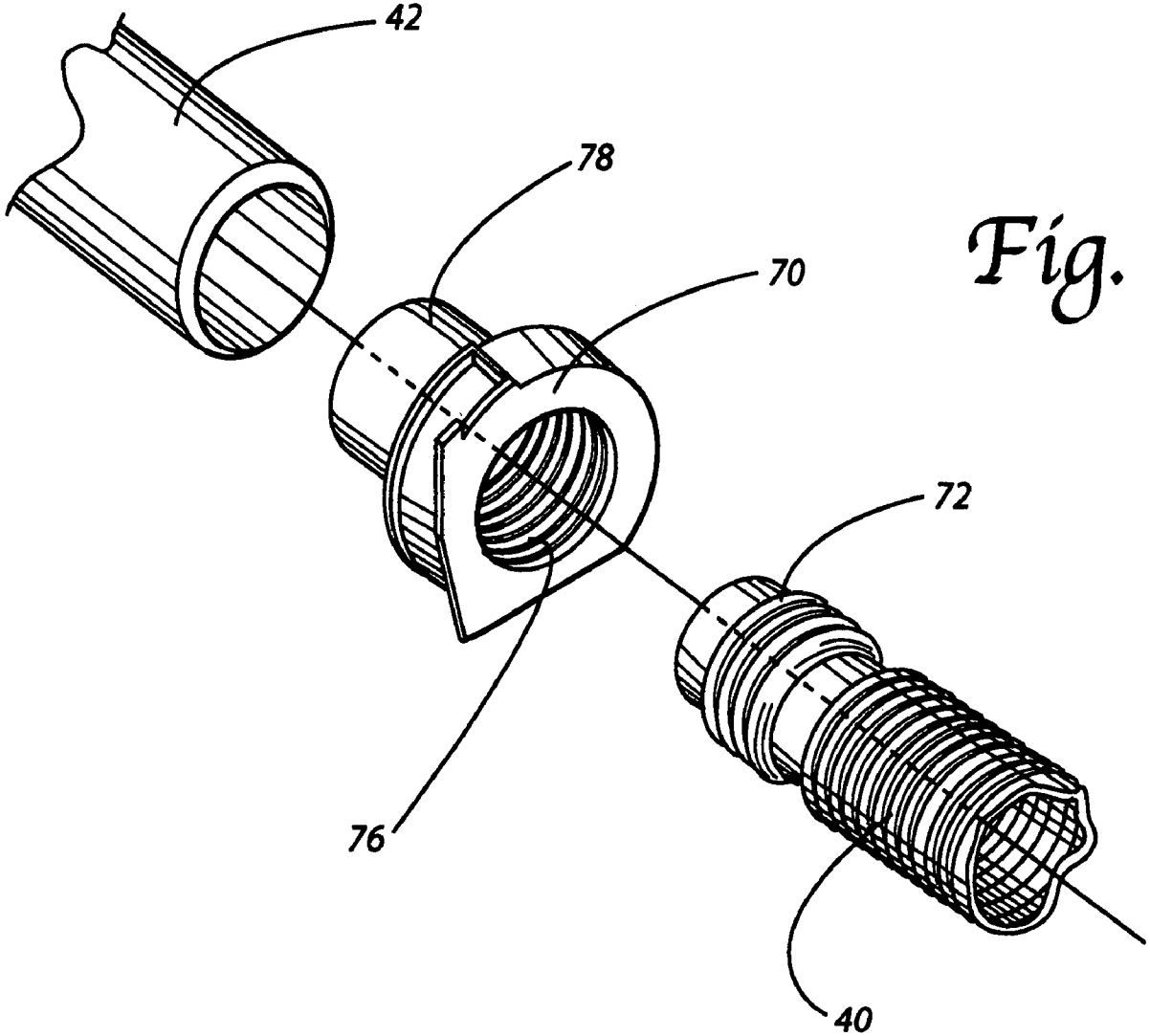
FIG. 5 is a detailed perspective view showing the connection of the hose and wand conduit through the conduit joiner.

As further illustrated in FIGS. 2, 3*a* and 3*b*, the tool holder 12 also includes a conduit joiner, generally designated by reference numeral 70, adjacent the first or wand receiver 52. As best illustrated in FIGS. 2 and 5, the conduit joiner 70 includes a mounting section 74 and a first end 76 providing a threaded cavity for receiving a threaded coupler 72 on the end of the hose 40. Additionally, the conduit joiner 70 includes a second, projecting end 78 that nests inside the sidewall of the wand conduit 42. The mounting section 74 snaps to the body 50 of the tool holder 12 by means of a resilient clip 75 integrally molded with the body 50 that captures the mounting section and holds it in place.

As indicated above, during normal operation of the upright vacuum cleaner dirt and debris drawn through the agitator cavity 36 travels through the hose 40 and into the wand conduit 42 by means of the conduit joiner 70. That air then travels through the hose 44, the inlet port and the internal delivery conduit to the dirt collection vessel 28. The clean air is then drawn into the suction generator 34, passes over the motor of the suction generator to provide cooling and then is expelled through the final filter and subsequently exhausted through the port 48.

During normal operation of the upright vacuum cleaner, an end of the wand extension 54 is inserted through the stabilizer 64 and is pressed into the socket 60 where it is securely held in position on the vacuum cleaner by friction engagement (see FIG. 2). As further shown the cleaning end 80 of the crevice tool 58 is inserted in the opposite end of the wand extension so that the crevice tool nests with the mounting collar 82 of the crevice tool resting on the upper edge of the wand extension 54. Accordingly, it should be appreciated that the crevice tool 58 is also securely held on the upright vacuum cleaner 10 during normal vacuum cleaner operation.

At certain times and for certain applications, normal operation of the upright vacuum cleaner 10 will not allow the user to complete the cleaning task at hand. For example, the user may want to perform above floor cleaning such as sucking dirt from the cushions of a chair, out of a window sill or off the top of a baseboard. For these applications the user withdraws the wand conduit 42 from the second end 78 of the conduit joiner 70. When this is done the suction generated by the suction generator 34 draws air into the now exposed end of the wand conduit 42. While the operator may simply use the end of the wand conduit 42 to complete the desired cleaning, the operator may want to remove the crevice tool 58 from the end of the wand extension 54 and insert it on the end of the wand conduit 42 to concentrate the suction power of the vacuum cleaner for cleaning.

Alternatively, the user may wish to connect the wand extension 54 to the wand conduit 42 to allow the operator to more easily reach a particular application, such as the above floor cleaning of draperies at the top of a window. In this situation the operator removes the wand extension 54 from the stabilizer 64 and socket 60 of the tool holder 12. Next, the crevice tool 58 is removed from the end of the wand extension. The crevice tool 58 may then be held on the vacuum cleaner 10 by inserting the cleaning end 80 of the crevice tool down through the stabilizer 64 and the socket 60 so that the cleaning end extends through the elongated slot 66 in the end wall 62 of the socket (see FIGS. 3*a* and 3*b*). The resulting friction fit securely holds the crevice tool 58 on the vacuum cleaner 10.

The wand extension 54 is then inserted on the end of the wand conduit 42 and the resulting extended wand may then be used by the operator with or without the crevice tool 58 to complete the cleaning operation.

Following completion of the manual cleaning operation, the wand extension 54 and crevice tool 58 are returned to the position shown in FIG. 2 on the tool holder 12 and the wand conduit 42 is reconnected to the second end 78 of the pipe 72 to re-establish communication between the suction generator 34 and the agitator cavity 36. As a result, the upright vacuum cleaner 10 is again reconfigured for normal floor cleaning operation.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, while a crevice tool 58 is shown, substantially any other type of cleaning tool may be held by the second receiver.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

The invention claimed is:

1. A tool holder for a floor cleaning apparatus including a wand and a cleaning tool, said tool holder comprising:

a body, said body including;

a wand receiver, a clip adjacent said wand receiver and a cleaning tool receiver in said wand receiver.

2. The tool holder of claim 1, further including a lug for mounting said body to the floor cleaning apparatus.

3. The tool holder of claim 1, further including a conduit joiner having a mounting section received in said clip.

4. The tool holder of claim 1, wherein said wand receiver includes a socket.

5. The tool holder of claim 4, wherein said wand receiver also includes a stabilizer.

6. The tool holder of claim 4, wherein said socket includes an end wall.

7. The tool holder of claim 6, wherein said cleaning tool receiver is provided in said end wall.

8. The tool holder of claim 7, wherein said cleaning tool receiver is an elongated slot in said end wall.

9. A vacuum cleaner including the tool holder of claim 1.

10. A tool holder for a floor cleaning apparatus including a wand and a cleaning tool, said tool holder comprising a body including a first receiver for holding the wand, a clip adjacent said first receiver and a second receiver in said first receiver for holding the cleaning tool when the wand is removed from said first receiver.

11. The tool holder of claim 10, further including a lug for mounting said body to the floor cleaning apparatus.

12. The tool holder of claim 10, further including a conduit joiner having a mounting section received in said clip.

13. The tool holder of claim 10, wherein said first receiver includes a socket.

14. The tool holder of claim 13, wherein said first receiver also includes a stabilizer.

15. The tool holder of claim 13, wherein said socket includes an end wall.

16. The tool holder of claim 15, wherein said second receiver is provided in said end wall.

17. The tool holder of claim 16, wherein said second receiver is an elongated slot in said end wall.

18. A vacuum cleaner including the tool holder of claim 10.

* * * * *